United States Patent [19]

Zingg

[11] Patent Number: 4,557,217

[45] Date of Patent: Dec. 10, 1985

[54] APPLICATOR FOR "CURTAIN-TYPE POURING" OF MOLTEN PLASTICS AND THE LIKE POURABLE MATERIALS

[75] Inventor: Hanskonrad Zingg, Basel, Switzerland

[73] Assignee: Ciba-Geigy Corporation, Ardsley, N.Y.

[21] Appl. No.: 639,041

[22] Filed: Aug. 9, 1984

[30] Foreign Application Priority Data

Aug. 19, 1983 [CH] Switzerland ..... 4534/83

[51] Int. Cl.[4] ..... B05B 1/04

[52] U.S. Cl. ..... 118/300; 118/DIG. 4; 118/325; 427/420; 239/596; 239/597; 239/600

[58] Field of Search ..... 118/325, DIG. 4, 300; 427/420; 239/596, 597, 600

[56] References Cited

U.S. PATENT DOCUMENTS

| | | | |
|---|---|---|---|
| 733,571 | 7/1903 | Allen | 239/596 |
| 3,705,693 | 12/1972 | Franz | 239/600 |
| 3,832,427 | 8/1974 | Mutch | 264/39 |
| 3,902,835 | 9/1975 | Theysohn | 425/188 |
| 4,075,976 | 2/1978 | Clayton | 118/324 |
| 4,131,236 | 12/1978 | Saunders | 239/596 X |

FOREIGN PATENT DOCUMENTS

| | | |
|---|---|---|
| 1190367 | 4/1965 | Fed. Rep. of Germany . |
| 354374 | 6/1961 | Switzerland . |

*Primary Examiner*—Shrive P. Beck
*Attorney, Agent, or Firm*—Harry Falber

[57] ABSTRACT

An applicator for curtain-pouring plastics or the like material of pourable consistency in which a base plate contains, inserted in a recess thereof, an applicator die block provided with a slit-shaped pouring orifice. On the base plate there are articulatedly mounted two half shells, forming an applicator head and adapted to be spread apart, and sealed with each other and with the base plate by means of sealing strips. Thus, there is no need for a re-adjustment of the orifice after each opening of the applicator head. Also, the width and/or length of the orifice can be readily changed by exchanging the applicator die block, and the entire structure is simple and of relatively low cost.

4 Claims, 1 Drawing Figure

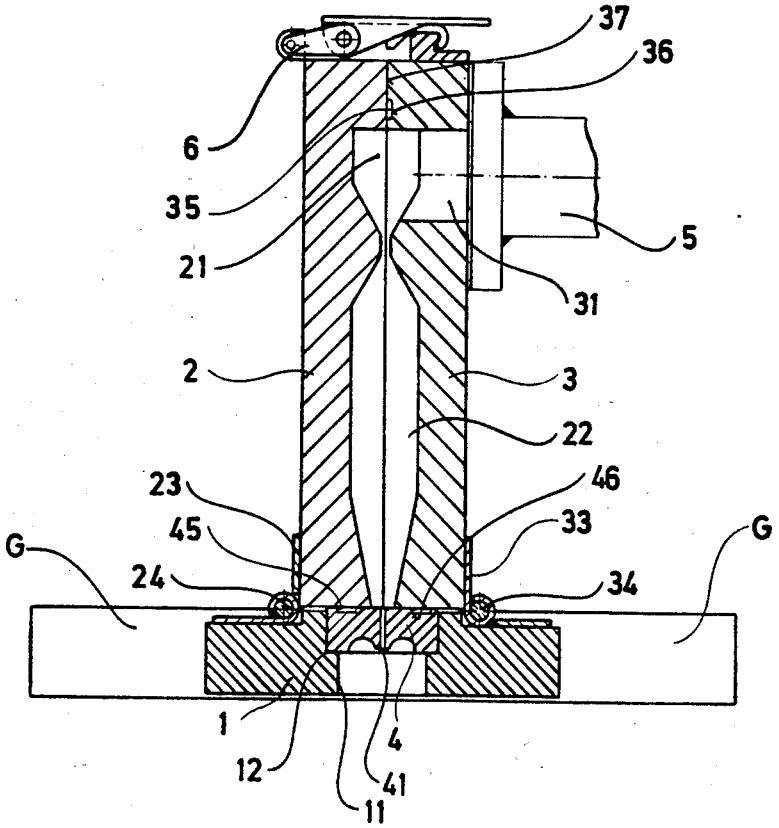
37
36
6
35
21
5
31
2
3
22
23
46
45
33
G
G
24
34
1
12
4
41
11

APPLICATOR FOR "CURTAIN-TYPE POURING" OF MOLTEN PLASTICS AND THE LIKE POURABLE MATERIALS

BACKGROUND OF THE INVENTION

This invention relates to an applicator for "curtain-type pouring" or extruding of molten plastics material or the like, which applicator comprises two half shells constituting an applicator head and adapted for being spread apart in order to open the said head, and which applicator also comprises a slit-shaped pouring orifice, from which the molten plastics material is poured as a sheet or "curtain".

Such "curtain-type" extrusion is widely used nowadays for coating objects of many kinds. Thus, "curtain-type" pouring is applied, for instance, in the photographic industry when manufacturing photographic materials, for the lacquer-coating of wooden and metal plates and, more recently, also for coating electrical conductor-bearing plates, for distance with solder-stopping or solder-repelling lacquer or the like (see. e.g. U.S. Pat. No. 4,230,793).

In order to apply lacquer coatings to a substrate it is conventional to use an applicator having a slit-shaped extruding orifice. This is an applicator comprising an applicator head having an adjustable extruding orifice at its lowermost end, through which orifice coating mass emerges in dosified quantities, to descend, as a free-falling curtain, downwardly upon the substrate therebelow which is to be coated.

An applicator of this known type consists of two halves or shells which are connected at their top ends while, at their lower ends, there is provided with each half or shell, a blade-like ledge or bar, the extrusion orifice being formed between the opposing edges of the two ledges, whereby the breadth or width of the extrusion orifice can be adjusted by approaching the two applicator head halves toward each other, or spreading them apart. In order to clean the applicator head, one of the two halves can be pivoted upwardly, thereby opening the applicator head. In a similar type of known applicator, which is described in U.S. Pat. No. 3,832,427 (John Mutch), one of the two halves is stationary while the other can be pivoted about a hinge at its lower end, and the head can thus be opened by moving the pivotable half away from the stationary half, thereby also permitting adjustment of the width of the extrusion slot.

These known applicators suffer from various serious drawbacks. Thus, after each opening of the applicator head, the width of the extrusion orifice has to be adjusted anew, which is a critical and cumbersome operation, the accuracy depending on the care taken by the operating personnel. Moreover, in the first-mentioned and more frequently used applicator type, the adjustment of the width of the extrusion orifice can only be arrested in the closing direction, while there is no definite arresting means against unintentional widening of the extrusion orifice. Moreover, exchange of the ledges or "pouring lips" forming the pouring slit when one of them has become damaged, is a complicated operation which requires in each case a time-consuming and expensive re-adjustment. Furthermore, the length of the pouring slit cannot be altered without difficulty . As a further drawback, the known applicator head has movable faces that must be sealed against loss of molten plastics material during operation. These sealing faces must be finished by fine grinding at which leakages can frequently occur. Lacquer which penetrates into such leaking spots will harden and will then render it difficult to open the applicator head, causing damage to the polished faces. Finally, the first-mentioned known type of applicator requires a heavy structure welded from chromium steel parts, and is thus relatively expensive to manufacture.

OBJECTS AND SUMMARY OF THE INVENTION

It is an object of the invention to provide an applicator of the initially described kind which is free of the drawbacks enumerated above and especially does not require any readjustment of the slit-shaped pouring orifice after each opening of the applicator head, which further permits easy changing of the configuration and especially of the width and/or length of the pouring orifice, and which also substantially reduces the problems involved in sealing the applicator head in its closed position satisfactorily.

These objects are attained, in accordance with the invention, by providing an applicator, of the initially described type, which comprises two half shells having each an upper end and a lower end and constituting, in upright, closed position, an applicator head having distributing channel means therein, advantageously sealed off at the top and laterally against leakage of molten plastics or the like material fed into the distributing channel means by way of an inlet orifice in at least one of the half shells.

a base plate having an elongated recess therein extending along a longitudinal axis thereof, the two half shells being supported, at their lower ends, on the said base plate on opposite sides of the recess and being articulatedly connected with the base plate for pivotal movement about axes extending parallel with the longitudinal recess axis, between the said closed position of the two half shells, and an open position in which these half shells are spread apart; and an applicator die block lodged firmly but removably in position in the recess and having a slit-shaped orifice for pouring molten plastics or the like material therethrough to emerge from the orifice as a curtain, which slit-shaped orifice extends substantially along the said longitudinal recess axis;

the said half shells, when in closed position, being at their lower ends in sealing contact with the applicator die block, and, when in open position, being spreadable apart far enough to permit removal and exchange of the applicator die block.

In a preferred embodiment of the applicator according to the invention, sealing means such as sealing strips or cords seal off the faces of the two half shells and the face of the applicator die block, which are in contact with each other, against leakage.

Further objects and advantages of the applicator according to the invention will become apparent from the detailed description of a preferred embodiment thereof hereinafter with reference to the single FIGURE of the accompanying drawing.

DETAILED DESCRIPTION OF THE DRAWING

This FIGURE shows a cross-sectional view of the applicator with the applicator head in upright position.

The applicator is mounted in a frame G and comprises a base plate 1, two half shells 2 and 3 forming the applicator head when in closed position, and an applicator die block 4 having a slit-shaped pouring orifice 41.

The two half shells 2 and 3 are provided with recesses or cavities, in those of their faces turned toward each other, forming distributing channels 21 and 22 which are in free communication with each other, and plastics material is fed into the channel 21 by way of a feeding pipe 5 connected to an inlet port 31 in the right hand half shell 3, and flows downward into the lower distributing chamber 22 which opens at its bottom above the pouring orifice 41 of the applicator die 4.

The two half shells 2 and 3 are articulatedly connected with the base plate 1 by means of two hinge joints 23 and 33 so that they can be pivoted about pivot axes 24 and 34 which extend parallel with the longitudinal axis of a recess 11 opening out of the base plate 1 in the top face and the bottom face of the latter, and at least substantially parallel with the pouring orifice 41 in the applicator die block 4 which fits snugly into a wider diameter upper part of the recess 11 and comes to rest upon a circumferential shoulder 12 formed in that recess. The two half shells 2 and 3 thus can be swivelled from the vertical position shown in the FIGURE in which the applicator head is closed, with their upper ends downward into an open position in which the two half shells are spread apart horizontally. In this position, the applicator head is open and the applicator die block 4 which rests unattached in the upper part of the recess 11 can be removed from the applicator head and replaced by another one having a slit-shaped orifice 41 of different width and/or length.

In order to seal the two half shells 2 and 3 against each other in closed position, there is provided a sealing strip or cord 35 which rests in a groove 36 that extends in the contact face 37 of the right hand half shell 3, surrounding the channels 21 and 22 at the top end laterally. In a similar manner, the underside at the lower end of each half shell 2,3 is sealed against the upper surface of the applicator die block 4 therebeneath by means of a sealing strip or cord 45 which is lodged in a circumferential groove 46 in that upper die block surface, surrounding the pouring slit 41.

In closed position, the two half shells 2 and 3 are held together by means of tensioning clamps 6.

In the applicator according to the invention, it is therefore very easy to exchange the applicator die block when it has become defect or clogged, while there is no need for an adjusting operation when a new block has been inserted in the recess of the base plate, as the position of the pouring slit in the applicator die block and the position of the latter in the base plate recess are both exactly pre-determined. There is no problem of altering the dimensions of the pouring slit, as this can be achieved by simply inserting a different block in which the slit has the desired different dimensions. As the sealing of the different parts of the applicator with each other does not occur on moving faces, it will be unproblematic. Finally, the construction of the applicator has the advantage of being very simple and relatively inexpensive.

The plastics or the like material to be poured with this applicator need not be in a molten state, but can be liquid and hardenable; it must be of a pourable consistency.

What is claimed is:

1. An applicator for curtain-type pouring of pourable plastics or the like material, comprising two half shells having each an upper end and a lower end and constituting, when both in upright closed position, an applicator head having distributor channel means therein, a base plate having an elongated recess therein extending along a longitudinal recess axis, said two half shells being supported, at their lower ends, on said base plate, on opposite sides of said recess, and being articulatedly connected with said base plate for pivotal movement about axes extending parallel with said longitudinal recess axis, between said closed position, of said two half shells, and an open position in which said half shells are spread apart; and an applicator die block lodged firmly but removably in position in said recess of said base plate and having a slit-shaped orifice adapted for pouring molten plastics or the like material from said distributing channel means therethrough to emerge as a curtain, said slit-shaped orifice extending substantially along said longitudinal recess axis;

said two half shells, when in closed position being at their lower ends in sealing contact with said applicator die block, and, when in open position, being spread apart far enough to permit removal or replacement of said applicator die block.

2. The applicator of claim 1, wherein said applicator head comprises first sealing means adapted for sealing off said distributing channel means from the outside, thereby avoiding leakage, from the latter means, of molten plastics material or the like to the outside.

3. The applicator of claim 2, wherein said two half shells have faces in contact with one another when said half shells are in closed position, and at least one of said half shell faces has groove means therein adapted for receiving said first sealing means, and said applicator die block has a sealing surface adapted for contact with said lower half shell ends, and die block groove means in said sealing surface, and said applicator comprises second sealing means lodged in said die block groove means.

4. The applicator of claim 3, wherein said first and second sealing means are strip-shaped, said first sealing means extend about said distributing channel means at the top and the sides of the latter, and said second sealing means surround said slit-shaped orifice.

* * * * *